United States Patent [19]

Yaghmaie et al.

[11] Patent Number: 4,575,380

[45] Date of Patent: Mar. 11, 1986

[54] FORMATION OF DISPERSE-SLURRY OF H-COAL RESIDUE

[75] Inventors: Farrokh Yaghmaie, Wappingers Falls; Stephen R. Vasconcellos, Fishkill, both of N.Y.

[73] Assignee: Texaco Inc., White Plains, N.Y.

[21] Appl. No.: 487,555

[22] Filed: Apr. 22, 1983

[51] Int. Cl.[4] ..... C10L 1/32

[52] U.S. Cl. ..... 44/51; 44/74; 44/76; 208/10; 208/14

[58] Field of Search ..... 44/51, 74, 76; 208/10, 208/14; 241/16

[56] References Cited

U.S. PATENT DOCUMENTS 4,282,006 8/1981 Funk ..... 44/51
4,331,530 5/1982 Qader ..... 208/10
4,364,741 12/1982 Villa ..... 44/51
4,400,263 8/1983 Kydd et al. ..... 208/10

FOREIGN PATENT DOCUMENTS 57-153091 9/1982 Japan ..... 44/51

OTHER PUBLICATIONS

Schwartz, Anthony et al. *Surface Active Agents and Detergents,* vol. II, Interscience Publishers, Inc., New York, 1958, pp. 462, 463 and 727.

*Primary Examiner*—William R. Dixon, Jr.
*Assistant Examiner*—Margaret B. Medley
*Attorney, Agent, or Firm*—Robert A. Kulason; Carl G. Seutter

[57] ABSTRACT

The problem of creaming during formation of disperse-slurry of H-coal residue by ball milling with water is eliminated by use, as an anti-creaming additive, of the triethanolamine salt of dodecylbenzene sulfonic acid.

15 Claims, No Drawings

FORMATION OF DISPERSE-SLURRY OF H-COAL RESIDUE

FIELD OF THE INVENTION

This invention relates to the formation of a disperse-slurry of H-Coal residue in aqueous medium characterized by elimination of creaming.

BACKGROUND OF THE INVENTION

As is well known to those skilled in the art, solid carbonaceous materials including coals of high and low rank, may be subjected to various processes to convert at least a portion of the carbon present in the solid to a liquid form; and these processes for hydrogenation of coal are commonly termed H-coal processes.

In these processes, finely powdered coal, typically of size such that at least 100 w % passes through a 40 mesh U.S. Standard sieve is contacted (in the form of a slurry) with hydrogen at 350° C.–600° C., say 450° C. and 1000–2500 psig, say 2000 psig to form hydrocarbons characterized by increased hydrogen content. Illustrative of processes for upgrading coal are those disclosed in U.S. Pat. Nos. 2,221,886, 2,860,101, and 3,341,447.

Product hydrocarbon liquids are separated by distillation leaving a hydrophobic solid characterized as follows:

TABLE

| Property | Value |
|---|---|
| w % carbon | 16 |
| density g/cc | 1.4 |
| boiling point | above 700° C. |
| melting point | 200–300° C. |

It is desirable to use this H-coal residue as a charge to a gasification reaction i.e. to convert it to a synthesis gas (containing carbon monoxide and hydrogen) by partial combustion; but this has proven to be difficult because of the problems encountered during feed preparation. The synthetic H-coal is a composition which has properties totally unlike other carbonaceous materials; and these render it particularly and uniquely difficult to handle.

It is found that if H-coal be subjected to grinding and mixing with water in an attempt to form a slurry suitable for use as feed to gasification, the slurry is characterized by problems the principal one of which is creaming.

Creaming, as the term is used in this specification, refers to the separation of phases in a system containing an aqueous medium and a finely divided hydrophobic solid medium, the latter forming a supernatant phase above a large body of liquid containing solids.

Creaming is distinguished from other phenomena which may be present in two phase systems including the following:

(i) Foaming refers to the formation of a gas-liquid mixture of low density adjacent to the surface of a lower body which may for example be a uniform mixture of liquids and solids. A foam is characterized by the presence of a large proportion of gas phase and a relatively small proportion of liquid phase and very little (usually no) solid phase; by a low density; and by the fact that it may frequently be eliminated or minimized by addition of agents which lower the surface tension of the liquid component of the foam. Elimination of foaming does not per se mean elimination of creaming.

(ii) Emulsification refers to the formation of a mixture of particles of one liquid with a second liquid. In commercial practice, one liquid is invariably water and the other is an oil. Thus the two common types of emulsions are oil-in-water (O/W) and water-in-oil (W/O). In certain instances, the presence of solid particles may stabilize emulsions by collecting at the oil-water interface and armoring the phase for which the solid has greater affinity. Addition of surface-active agents can enhance or destroy the stability of the emulsion, but it has no effect on the creaming phenomenon.

It is particularly to be noted that procedures which solve other problems do not necessarily solve the problem of creaming. For example, it is possible to utilize a system which provides satisfactory emulsifying or dispersing properties but which fails to solve the problem of creaming.

It is an object of this invention to provide a process for eliminating creaming in a disperse slurry of H-coal residue in aqueous medium. Other objects will be apparent to those skilled in the art.

STATEMENT OF THE INVENTION

In accordance with certain of its aspects, this invention is directed to a process for forming a disperse-slurry in aqueous medium of particles of a hydrophobic H-coal residue containing phenolic components which are conducive to creaming which comprises contacting said hydrophobic H-coal residue, containing phenolic components which are conducive to creaming, with an alkali metal salt or an amine salt of an alkylbenzene sulfonic acid wherein said alkyl group contains 10–18 carbon atoms whereby said salt is adsorbed onto said particles; and comminuting, in the presence of aqueous medium, said hydrophobic H-coal residue, containing phenolic components which are conducive to creaming, in the presence of said alkali metal salt or amine salt of said alkylbenzene sulfonic acid wherein said alkyl group contains 10–18 carbon atoms thereby forming a slurry of comminuted hydrophobic H-coal residue in aqueous medium characterized by decreased creaming, enhanced dispersability, decreased wall adhesion, and reduced phase separation; and recovering said slurry of comminuted hydrophobic H-coal residue in aqueous medium characterized by decreased creaming, enhanced dispersability, decreased wall adhesion, and reduced phase separation.

DESCRIPTION OF THE INVENTION

The charge particles of H-coal residue which may be treated by the process of this invention are typically those attained as by-product from H-coal processes. This charge is finely divided to a particle size such that at least about 70 w % passes through 60 mesh (U.S. Standard) sieve. Preferably 100 w % passes through a 40 mesh sieve and 0 w % passes through a 400 mesh sieve. Commonly 90–100 w % passes through a 40 mesh sieve and 80–90 w % is retained on a 400 mesh sieve. It may be considered as having a 40–400 mesh particle size.

These charge particles are mixed with a process-derived liquid, typically having an ibp of greater than 100° C., commonly 150° C., 300° C., say 230° C. This liquid may have a density of 0.70–1.10, say 0.85.

The charge particles (100 parts) are commonly mixed with 200–300 parts, say 230 parts of process-derived liquid and hydrogenated at 350° C.–600° F., say 450° C.

and 1000–2500 psig, say 2000 psig partial pressure of hydrogen for 30–120 minutes, say 60 minutes in liquid phase in the presence of catalyst. The catalyst, maintained in a liquid phase ebullient bed hydrocracker, may preferably be 0.01–10 nanometers, say 0.5 nanometer particles of (i) silica-promoted cobalt molybdate, (ii) molten zinc chloride, etc.

Effluent from H-coal treating may be subjected to various processing steps to permit recovery of (i) desired liquids including process-derived liquid and a (ii) solid hydrophobic H-coal residue the solid being characterized by the following properties:

TABLE

| Property | Value | Preferred |
|---|---|---|
| w % carbon | 9–20 | 16 |
| density g/cc | 1.2–1.5 | 1.4 |
| boiling point (°C.) | above 700 | above 700 |
| melting point (°C.) | 200–300 | 260 |
| particle size (microns) | 75–1000 | 100 |
| phenolic compounds w % | 2–10 | 5 |

In order to utilize this residue in a synthesis gas generation operation, it is desired to form a disperse slurry in aqueous medium. Aqueous medium may be fresh water or recycle water from the process or any aqueous medium which is available at the unit and which is free of undesirable components.

In practice of the process of this invention, 100 parts of the hydrophobic H-coal containing undesirable phenolic components, are contacted with 0.01–1 parts, preferably 0.01–0.1 parts, say 0.05 parts of as additive an alkali metal (including ammonium) salt or an amine salt of an alkylbenzene sulfonic acid wherein the alkyl group contains 10–18, say 12 carbon atoms. Typical of these salts may be the following (the first two being preferred):

TABLE

| | |
|---|---|
| ammonium | dodecylbenzene sulfonate |
| mono(triethanolamine) | dodecylbenzene sulfonate |
| diethanolamine | dodecylbenzene sulfonate |
| sodium | dodecylbenzene sulfonate |
| triethanolamine | tetradecylbenzene sulfonate |
| ammonium | hexadecylbenzene sulfonate |

It is preferred that the additive be added to the H-coal residue and mixed together with 25–100 parts, say 50 parts of aqueous liquor at 10°–40° C., say 25° C. and the mixture be allowed to sit for 10–45 minutes, say 30 minutes during which period, the additive soaks into the H-coal residue as the mixture is maintained quiescent.

At the end of the soaking period, there is added 25–100 parts, say 50 parts of additional aqueous liquor, making in all 50–200 parts, say 100 parts of aqueous liquor.

The mixture is then comminuted under shear conditions. Preferably wet grinding is effected in a ball mill, although it may be possible to effect comminution with shearing in other equipment typified by (i) a Rod Mill, (ii) a Raymond Mill or an (iii) ultrasonic mill.

As ball milling is carried out in the preferred embodiment over 60–960 minutes, say 480 minutes, the slurry of H-coal residue in aqueous medium is gradually homogenized as the H-coal residue is reduced in particle size during shearing and becomes dispersed within the aqueous medium.

It is a feature of the process of this invention that use of the additives noted permits attainment of advantages not attained by use of other additives. Among these advantages may be noted decreased creaming.

It is commonly found that the tendency of the mix to cream is substantially decreased. Presence of the additive of the process of this invention permits attainment of the desired disperse-slurry with minimum creasing.

The product ball milled mixture which typically contains 100 part of H-coal residue per 50–200 parts, say 100 parts of liquid and 0.01–0.1 parts, say 0.05 part of additive is found to be of suitable properties including stability so that it may serve as charge to a unit for preparing synthesis gas—as is disclosed for example in U.S. Pat. No. 2,818,326 to Texaco as assignee of Eastman.

DESCRIPTION OF PREFERRED EMBODIMENTS

Practice of the process of this invention according to its preferred aspects will be apparent to those skilled in the art from the following wherein as elsewhere in this specification, all parts are parts by weight unless otherwise specified.

EXAMPLE

In this example which represents the best mode presently known to me of practicing the process of this invention, the charge material is 100 parts of an H-coal residue having the following properties:

TABLE

| Property | Value |
|---|---|
| w % carbon | 16 |
| density g/cc | 1.4 |
| boiling point °C. | above 700 |
| melting point °C. | 260 |
| particle size microns | 100 |
| phenolic compounds w % | 5 |

To this charge material, there is added 0.05 parts of additive triethanolamine dodecylbenzene sulfonate in 50 parts of water at 25° C. and this mixture is permitted to stand for 30 minutes as the H-coal residue adsorbs the additive.

There is then added 50 parts of water (to yield a total of 100 parts of water) and the mix is subjected to wet ball milling in a Ball Mill at 25° C. for 8 hours.

At this time, the % Dispersion is determined by a settling tube measurement, the results being reported as %, with high % numbers being preferred. The height of the Cream Layer is also determined, the results being reported in millimeters, a low number (preferably 0) being more preferred.

EXAMPLE II

In this Example, the procedure of Example I is duplicated except that the additive is ammonium dodecylbenzene sulfonate.

EXAMPLE III

In this control Example, no additive is present. The results of Examples I–III are as follows:

TABLE

| Example | Additive | Height of Cream Layer | % Change in Height | % Dispersion |
|---|---|---|---|---|
| I | Triethanolamine dodecylbenzene sulfonate | 0 | 100 | 90 |
| II | Ammonium | 0 | 100 | 80 |

TABLE-continued

| Example | Additive | Height of Cream Layer | % Change in Height | % Dispersion |
|---|---|---|---|---|
| | dodecylbenzene sulfonate | | | |
| III* | none | 25 | 0 | 5 |

From the above table, it is apparent that the novel process of this invention employing the noted additives permits attainment of outstanding results. Specifically it is noted that desirably the height of the cream layer decreased to 0, the % change increased to 100% and the % dispersion increased up to 80%–90%.

Results comparable to those of Example I may be attained if the following additives be employed.

TABLE

| Example | Additive |
|---|---|
| IV | sodium dodecylbenzene sulfonate |
| V | ammonium tetradecylbenzene sulfonate |
| VI | sodium tetradecylbenzene sulfonate |
| VII | triethanolamine tetradecylbenzene |
| VIII | potassium dodecylbenzene sulfonate |
| IX | ammonium hexadecylbenzene sulfonate |
| X | sodium hexadecylbenzene sulfonate |

In a series of control runs, the following additives were also employed:

TABLE

| Example | Additive | Height of Cream Layer | % Dispersion |
|---|---|---|---|
| XI* | Polyoxyethylene cocoamine | 10 | 10 |
| XII* | Polyethylene glycol ether of primary alcohol | 20 | 30 |
| XIII* | Polyoxyethylene nonylphenol | 10 | 50 |
| XIV* | Cetyltrimethyl ammonium bromide | 15 | 10 |
| XV* | Ethyleneoxide-t-amine condensate | 10 | 15 |

In each of these control examples, it was noted that there was undesirably a substantial cream layer (10–20 mm); and the % dispersion was undesirably low (10%–50% dispersion).

Although this invention has been illustrated by reference to specific embodiments, it will be apparent to those skilled in the art that various changes and modifications may be made which clearly fall within the scope of this invention.

What is claimed is:

1. The process for forming a disperse-slurry in aqueous medium of 40–400 mesh particles of a hydrophobic H-coal residue containing phenolic components which are conducive to creaming which comprises contacting said hydrophobic H-coal residue, containing phenolic components which are conductive to creaming, with 0.01–1 parts per 100 parts of residue of an alkali metal salt or an amine salt of an alkylbenzene sulfonic acid wherein said alkyl group contains 10–18 carbon atoms whereby said salt is absorbed onto said particles; and comminuting, in the presence of 50–200 parts of aqueous medium per 100 parts of residue, said hydrophobic H-coal residue, containing phenolic components which are conductive to creaming, in the presence of said alkali metal salt or amine salt of said alkylbenzene sulfonic acid wherein said alkyl group contains 10–18 carbon atoms thereby forming a slurry of comminuted hydrophobic H-coal residue in aqueous medium characterized by decreased creaming, enhanced dispersability, decreased wall adhesion, and reduced phase separation; and recovering said slurry of comminuted hydrophobic H-coal residue in aqueous medium characterized by decreased creaming, enhanced dispersability, decreased wall adhesion, and reduced phase separation.

2. The process for enhancing the wettability and dispersability of H-coal residues while minimizing creaming as claimed in claim 1 wherein said salt is an amine salt.

3. The process for enhancing the wettability and dispersability of H-coal residues while minimizing creaming as claimed in claim 1 wherein said salt is an ethanolamine salt.

4. The process for enhancing the wettability and dispersability of H-coal residues while minimizing creaming as claimed in claim 1 wherein said salt is a diethanolamine salt.

5. The process for enhancing the wettability and dispersability of H-coal residues while minimizing creaming as claimed in claim 1 wherein said salt is a triethanolamine salt.

6. The process for enhancing the wettability and dispersability of H-coal residues while minimizing creaming as claimed in claim 1 wherein said salt is a salt of dodecylbenzene sulfonic acid.

7. The process for enhancing the wettability and dispersability of H-coal residues while minimizing creaming as claimed in claim 1 wherein said salt is a salt of tetradecylbenzene sulfonic acid.

8. The process for enhancing the wettability and dispersability of H-coal residues while minimizing creaming as claimed in claim 1 wherein said salt is a salt of hexadecylbenzene sulfonic acid.

9. The process for enhancing the wettability and dispersability of H-coal residues while minimizing creaming as claimed in claim 1 wherein said salt is triethanolamine dodecylbenzene sulfonate.

10. The process for enhancing the wettability and dispersability of H-coal residues while minimizing creaming as claimed in claim 1 wherein said salt is amine dodecylbenzene sulfonate.

11. The process for enhancing the wettability and dispersability of H-coal residues while minimizing creaming as claimed in claim 6 wherein said salt is present in amount of 0.01–0.1 parts per 100 parts of H-coal residue.

12. The process for forming a disperse-slurry in aqueous medium of 40–400 mesh particles of a hydrophobic H-coal residue containing phenolic components which are conducive to creaming which comprises contacting 100 parts of H-coal residue with 0.01–0.1 parts of ammonium dodecylbenzene sulfonate;

comminuting, in the presence of 50–200 parts of aqueous medium, said H-coal residue and said sulfonate thereby forming a slurry of comminuted hydrophobic H-coal residue in aqueous medium characterized by decreased creaming, enhanced dispersability, decreased wall adhesion, and reduced phase separation; and recovering said slurry of comminuted hydrophobic H-coal residue in aqueous medium characterized by decreased creaming, enhanced dispersability, decreased wall adhesion, and reduced phase separation.

13. The process for forming a disperse-slurry in aqueous medium of 40–400 mesh particles of a hydrophobic H-coal residue containing phenolic components which are conducive to creaming as claimed in claim 12 wherein said H-coal residue is soaked with at least a portion of said sulfonate prior to comminuting.

14. The process for enhancing the wettability and dispersability of 40–400 mesh particles of H-coal residue while minimizing creaming which comprises comminuting 40–400 mesh particles of a hydrophobic H-coal residue in 50–200 parts of aqueous medium per 100 parts of residue in the presence of 0.01–0.1 parts per 100 parts of residue of an alkali metal salt or an amine salt of an alkylbenzene sulfonic acid wherein said alkyl group contains 10–18 carbon atoms thereby forming a slurry of comminuted hydrophobic H-coal residue in aqueous medium characterized by decreased creaming and enhanced dispersability; and recovering said slurry of comminuted hydrophobic H-coal residue in aqueous medium.

15. A disperse-slurry in aqueous medium comprising 100 parts of 40–400 mesh particles of a hydrophobic H-coal residue containing phenolic components which are conducive to creaming;

0.01–0.1 parts of an alkali metal salt or an amine salt of an alkylbenzene sulfonic acid wherein the alkyl group contains 10–18 carbon atoms; and 50–200 parts of aqueous medium, said disperse-slurry being characterized by decreased creaming, enhanced dispersability, decreased wall adhesion, and reduced phase separation.

* * * * *